US010893718B2

(12) United States Patent
Walsh et al.

(10) Patent No.: US 10,893,718 B2
(45) Date of Patent: Jan. 19, 2021

(54) INDIVIDUALLY CONFORMING IMPACT ATTENUATING LINER FOR A HELMET

(71) Applicant: Artisent, LLC, Simpson, PA (US)

(72) Inventors: Desmond Walsh, Duxbury, MA (US); Matthew Anthony Hanudel, Waltham, MA (US); Duco W. Noordzij, Roslindale, MA (US)

(73) Assignee: GENTEX CORPORATION, Simpson, PA (US)

( * ) Notice: Subject to any disclaimer, the term of this patent is extended or adjusted under 35 U.S.C. 154(b) by 16 days.

(21) Appl. No.: 15/517,175

(22) PCT Filed: Oct. 8, 2015

(86) PCT No.: PCT/US2015/054656

§ 371 (c)(1),
(2) Date: Apr. 6, 2017

(87) PCT Pub. No.: WO2016/057773

PCT Pub. Date: Apr. 14, 2016

(65) Prior Publication Data

US 2017/0295882 A1 Oct. 19, 2017

Related U.S. Application Data

(60) Provisional application No. 62/061,909, filed on Oct. 9, 2014.

(51) Int. Cl.

| | |
|---|---|
| ***A42B 3/12*** | (2006.01) |
| ***A42B 3/08*** | (2006.01) |
| ***A42B 3/10*** | (2006.01) |

(52) U.S. Cl.

CPC ..... *A42B 3/127* (2013.01); *A42B 3/08* (2013.01); *A42B 3/105* (2013.01)

(58) Field of Classification Search

CPC ..... A42B 3/127; A42B 3/08; A42B 3/105; A42B 3/10; A42B 3/12; A42B 3/125;

(Continued)

(56) References Cited

U.S. PATENT DOCUMENTS 3,613,113 A * 10/1971 Alleo ..... A42B 3/10 2/420
3,729,744 A * 5/1973 Rappleyea ..... A42B 3/127 2/420

(Continued)

FOREIGN PATENT DOCUMENTS

| | | |
|---|---|---|
| EP | 0217996 A1 | 4/1987 |
| EP | 0217996 | 2/1990 |
| FR | 2557437 A3 | 7/1985 |

OTHER PUBLICATIONS

European Patent Application No. 15848919.5, Communication Pursuant to Article 94(3) EPC, dated Nov. 2, 2018, 2 pages.

(Continued)

*Primary Examiner* — Heather Mangine
(74) *Attorney, Agent, or Firm* — Morgan, Lewis & Bockius LLP

(57) ABSTRACT

An impact-attenuating liner for a helmet includes a liner body made from an impact-absorbing material and a plurality of pads removably attached to an interior surface of the liner body, each of the pads being repositionable at different locations on the interior surface of the liner body. A retention system may be attached to the liner body and configured to secure the liner to the wearer's head during use. The liner may be configured to provide substantially uniform impact protection throughout the interior region of the helmet.

22 Claims, 6 Drawing Sheets

(58) Field of Classification Search
CPC ..... A42B 3/128; A42B 3/145; A42B 3/14; A42B 3/142; A42B 3/147; A42B 3/085; A63B 71/10
USPC ..... 2/421, 415, 411, 414
See application file for complete search history.

(56) References Cited

U.S. PATENT DOCUMENTS 3,820,163 A * 6/1974 Rappleyea ..... A42B 3/125 2/420
3,843,970 A * 10/1974 Marietta ..... A42B 3/127 2/415
4,075,714 A * 2/1978 Ryder ..... A42B 3/0493 2/421
4,439,871 A * 4/1984 Plastino ..... A42B 1/08 2/183
4,653,123 A * 3/1987 Broersma ..... A42B 3/0493 2/171.3
4,766,610 A * 8/1988 Mattes ..... A42B 3/127 2/414
4,901,373 A * 2/1990 Broersma ..... A42B 3/066 2/421
5,088,129 A * 2/1992 Kamata ..... A42B 3/127 2/411
5,088,130 A * 2/1992 Chiarella ..... A42B 3/066 2/411
5,093,936 A * 3/1992 Copeland ..... A42B 3/14 2/419
5,113,534 A * 5/1992 Lane ..... A42B 3/145 2/416
5,123,121 A * 6/1992 Broersma ..... A42B 3/066 2/421
5,231,703 A * 8/1993 Garneau ..... A42B 3/066 2/414
5,351,341 A * 10/1994 Broersma ..... A42B 3/066 2/412
5,351,342 A * 10/1994 Garneau ..... A42B 3/066 2/414
5,517,691 A * 5/1996 Blake ..... A42B 3/125 2/414
5,551,094 A * 9/1996 Navone ..... A42B 3/08 2/418
5,598,588 A * 2/1997 Lee ..... A42B 3/08 2/421
5,603,117 A * 2/1997 Hudner, Jr. ..... A42B 3/127 2/423
5,745,923 A * 5/1998 Katz ..... A42B 3/00 2/411
5,774,901 A * 7/1998 Minami ..... A42B 3/147 2/421
5,983,405 A * 11/1999 Casale ..... A42B 3/145 2/417
5,996,126 A * 12/1999 Barthold ..... A42B 3/14 2/410
6,159,324 A * 12/2000 Watters ..... A42B 3/322 156/242
6,189,156 B1 * 2/2001 Loiars ..... A42B 3/20 2/424
6,219,850 B1 * 4/2001 Halstead ..... A42B 3/06 2/414
6,292,952 B1 * 9/2001 Watters ..... A42B 3/08 2/411
6,711,751 B1 * 3/2004 Muskovitz ..... A42B 3/04 2/10
6,817,039 B1 * 11/2004 Grilliot ..... A42B 3/122 2/413
6,983,488 B2 * 1/2006 Foote ..... A42B 3/003 2/10
7,376,980 B2 * 5/2008 Bullock ..... A42B 3/066 2/421
7,770,239 B1 * 8/2010 Goldman ..... A42B 3/142 2/415
8,001,622 B1 * 8/2011 Culley ..... A42B 3/127 2/267
8,418,269 B1 * 4/2013 McBride ..... A42B 3/285 2/410
9,622,533 B2 * 4/2017 Warmouth ..... A42B 3/122
9,846,012 B2 * 12/2017 Crye ..... A42B 3/085
9,907,347 B2 * 3/2018 Allen ..... A42B 3/125
2003/0070200 A1 * 4/2003 Crye ..... A42B 3/08 2/6.6
2005/0262619 A1 * 12/2005 Musal ..... A42B 3/08 2/421
2006/0096011 A1 * 5/2006 Dennis ..... A42B 3/08 2/414
2006/0179537 A1 * 8/2006 Dennis ..... A42B 3/08 2/6.6
2007/0089219 A1 * 4/2007 Trainor ..... A42B 3/08 2/421
2009/0158506 A1 * 6/2009 Thompson ..... A42B 3/127 2/411
2009/0222964 A1 * 9/2009 Wiles ..... A42B 3/125 2/6.6
2010/0170068 A1 * 7/2010 Musal ..... A42B 3/145 24/68 D
2010/0186150 A1 * 7/2010 Ferrara ..... A42B 3/128 2/412
2010/0281603 A1 * 11/2010 Ho ..... A42B 3/04 2/411
2011/0083240 A1 * 4/2011 Crye ..... A42B 3/085 2/2.5
2012/0036620 A1 * 2/2012 Harris ..... A42B 3/127 2/414
2013/0000017 A1 * 1/2013 Szalkowski ..... A42B 3/127 2/414
2013/0007950 A1 * 1/2013 Arai ..... A42B 3/127 2/414
2013/0047309 A1 * 2/2013 Strum ..... F41H 1/04 2/2.5
2013/0086733 A1 * 4/2013 Szalkowski ..... A42B 3/12 2/414
2013/0125296 A1 * 5/2013 Rabinovitch ..... A63B 24/00 2/413
2014/0109301 A1 * 4/2014 Hall ..... A42B 3/142 2/416
2014/0331393 A1 * 11/2014 DaSilva ..... A42B 3/08 2/414
2014/0338104 A1 * 11/2014 Vito ..... A42B 3/127 2/414
2014/0345036 A1 * 11/2014 Sargenti ..... A42B 3/125 2/414
2015/0272257 A1 * 10/2015 Pritz ..... A42B 3/127 2/414
2016/0088891 A1 * 3/2016 Walsh ..... A42B 3/04 2/421
2017/0224042 A1 * 8/2017 Abraham ..... A42B 3/127
2017/0273390 A1 * 9/2017 Maloney ..... A42B 3/145
2018/0055133 A1 * 3/2018 Erb ..... A42B 3/124
2018/0092424 A1 * 4/2018 Hall ..... A42B 3/142

OTHER PUBLICATIONS

European Patent Application No. 15848919.5, Annex to the Communication, dated Nov. 2, 2018, 2 pages.
Extended European Search Report dated Apr. 19, 2018 for European Patent Application No. 15848919.5.
International Search Report dated Jan. 4, 2016 for International Patent Application No. PCT/US2015/054656.
Written Opinion dated Jan. 4, 2016 for International Patent Application No. PCT/US2015/054656.

* cited by examiner

INDIVIDUALLY CONFORMING IMPACT ATTENUATING LINER FOR A HELMET

CROSS-REFERENCE TO RELATED APPLICATIONS

This application is a U.S. National Stage of International Patent Application No. PCT/US2015/054656, filed Oct. 8, 2015, which claims the benefit of U.S. Provisional Patent Application No. 62/061,909 filed Oct. 9, 2014, each of which is incorporated by reference herein in its entirety.

FIELD OF THE INVENTION

The present invention, according to some embodiments, relates to a liner that may be positioned into an interior region of a helmet. In some embodiments, the liner is configured to provide substantially uniform impact protection throughout the interior region of the helmet. In further embodiments, the liner includes a plurality of pads that may be individually positioned and/or repositioned to fit a user's head.

BACKGROUND OF THE INVENTION

A current liner system for helmets includes a plurality of separate impact-absorbing foam pads that are positioned in the interior of a helmet. An example of such a system is the ZORBIUM® ACTION PAD (ZAP™) systems available from TEAM WENDY®. One drawback of such systems is that the foam pads comprise foam blocks that do not generally match the geometry of the wearer's head, leading to discomfort or instability of the helmet on the wearer's head. A wearer may remove one or more the foam pads in order to improve fit and comfort, however, removal of the foam pads could reduce the impact protection from that portion of the helmet. Another drawback of these systems is that the materials used in the foam pads (e.g., ZORBIUM® polyurethane foam) absorb water. This can lead to increased weight on the wearer's head and greater discomfort.

SUMMARY OF THE INVENTION

The present invention, according to some embodiments, relates to a liner that may be positioned into an interior region of a helmet. In some embodiments, the liner includes a liner body sized and configured to fit within an interior of the helmet and around a portion of a wearer's head. The liner body may be constructed from an impact-absorbing material and has an outer surface with a convex curvature and an interior surface with a concave curvature. In some embodiments, the liner is configured to provide different levels of impact attenuation to different portions of the wearer's head. According to certain embodiments, the impact-absorbing material may be expanded polypropylene. In further embodiments, the impact-absorbing material of the liner body can have different densities at different locations along the liner body. In some embodiments, the liner body has a substantially uniform thickness between the outer surface and the interior surface. In some embodiments, the liner body is substantially rigid. In some embodiments, the liner includes one or more fasteners on the outer surface of the liner body, the one or more fasteners being configured to removably attach the liner to the interior of the helmet. The one or more fasteners may include hook-and-loop or hook-and-pile type fasteners or portions thereof.

In some embodiments, the liner also includes a plurality of pads removably attached to the interior surface of the liner body, each of the pads being repositionable at different locations on the interior surface of the liner body. Preferably, each of the pads can be repositioned at different locations on the interior surface of the liner body while the liner body is attached to the helmet. The pads may include a foam material enclosed in fabric, and may include a material that does not substantially absorb or retain water. In some embodiments, the liner additionally includes a front pad positioned at a front of the liner body. In some embodiments, the pads are removably attached to the interior surface of the liner body using hook-and-loop or hook-and-pile type fasteners.

In yet further embodiments, the liner includes a retention system attached to the liner body and configured to secure the liner to the wearer's head during use. The retention system according to some embodiments includes straps that are configured to wrap around the wearer's chin. The retention system may also include a nape pad configured to abut against a neck of the wearer. In some embodiments, the retention system is connected to the liner body at a plurality of attachment points (e.g., four attachment points). In certain embodiments, the retention system is connected to the liner body using pins, bolts, screws, or other mechanical fasteners. In other embodiments, the retention system is attached to the liner body without separate fasteners. In some embodiments, the liner body includes one or more pairs of apertures, and the retention system includes one or more straps that are woven through the one or more pairs of apertures. In some embodiments, the liner body includes a pair of front apertures and a pair of rear apertures. In some such embodiments, the retention system includes a front strap passed through the pair of front apertures and a rear strap passed through the pair of rear apertures.

In certain embodiments, a liner as described herein may be combined with a helmet in a kit. The helmet may be a sport, police, or military helmet, for example. In other embodiments, a kit may include a liner body and a plurality of pads as described herein without a helmet. In yet further embodiments, a kit may also include a retention system as described herein that may be attached to the liner body.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention can be embodied in different forms and thus should not be construed as being limited to the embodiments set forth herein.

DETAILED DESCRIPTION

The present invention will now be described more fully hereinafter with reference to the accompanying Figures, in which representative embodiments are shown. The present invention can, however, be embodied in different forms and should not be construed as limited to the embodiments set forth herein. Rather, these embodiments are provided to describe and enable one of skill in the art.

Figure 1:
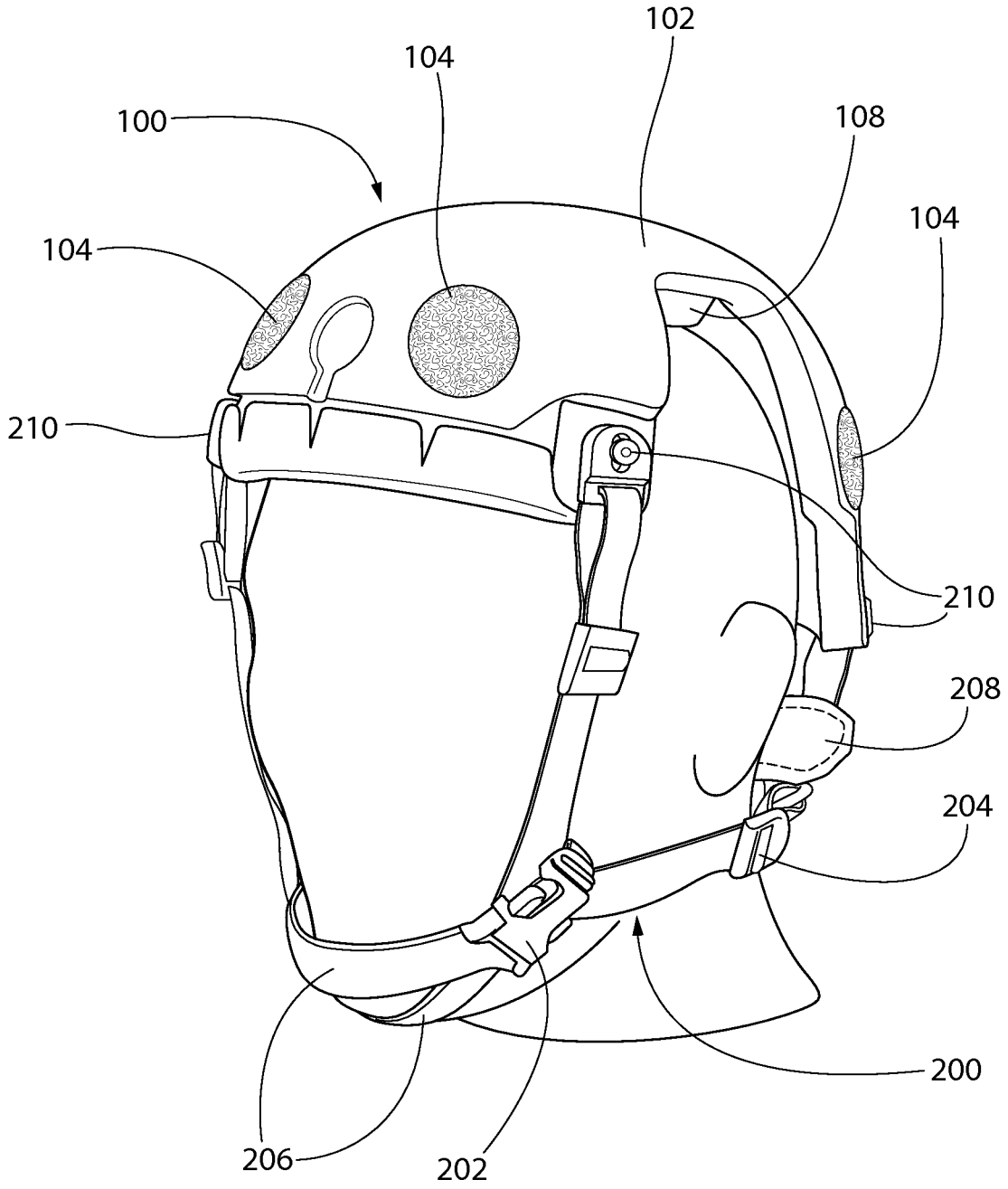
FIG. 1 is a front left perspective view of a liner in accordance with an embodiment of the invention shown with the retention system and on a manikin.
Figure 2:
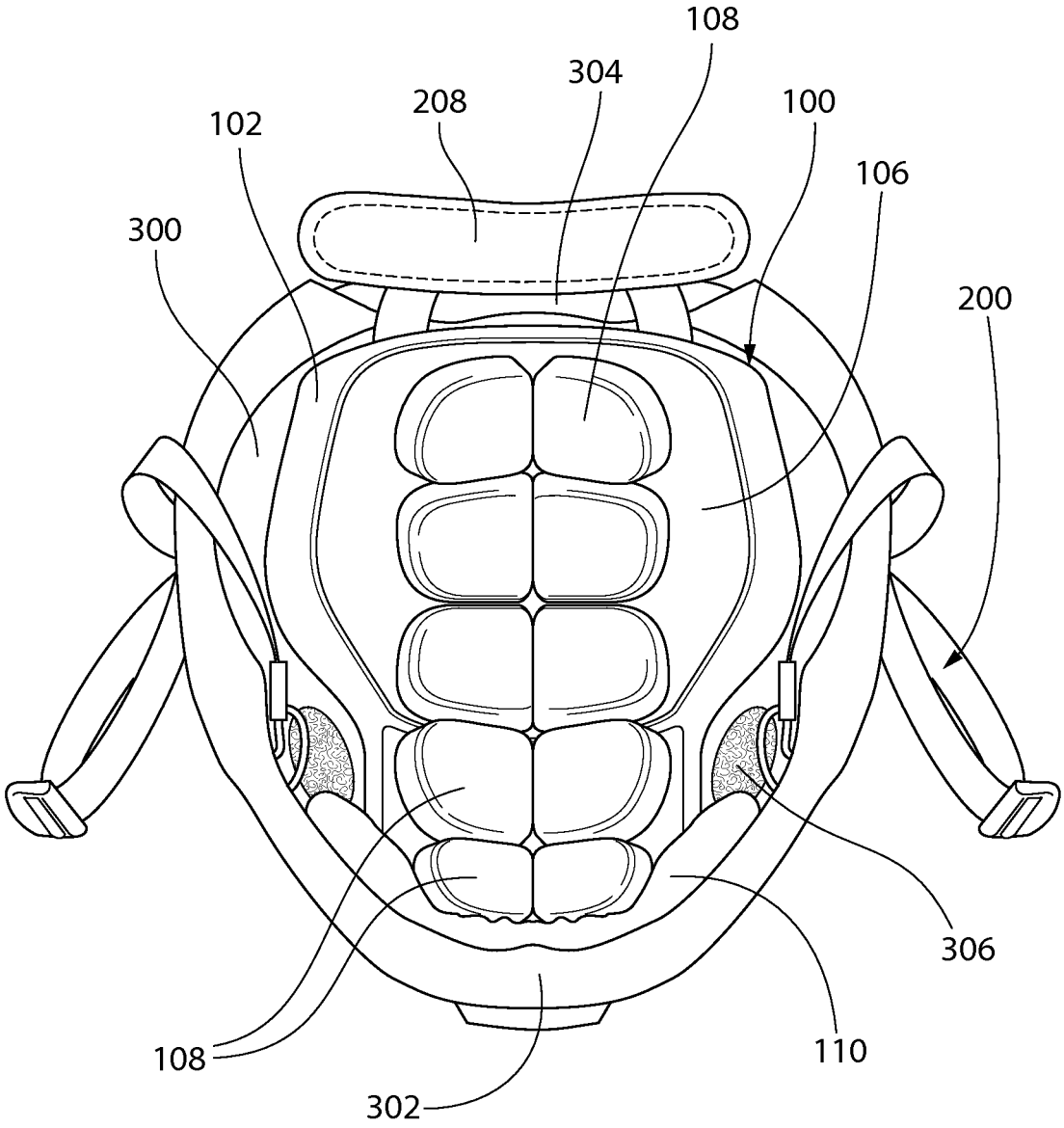
FIG. 2 is a bottom view of the liner of FIG. 1 positioned within an interior region of a helmet.
Figure 3:
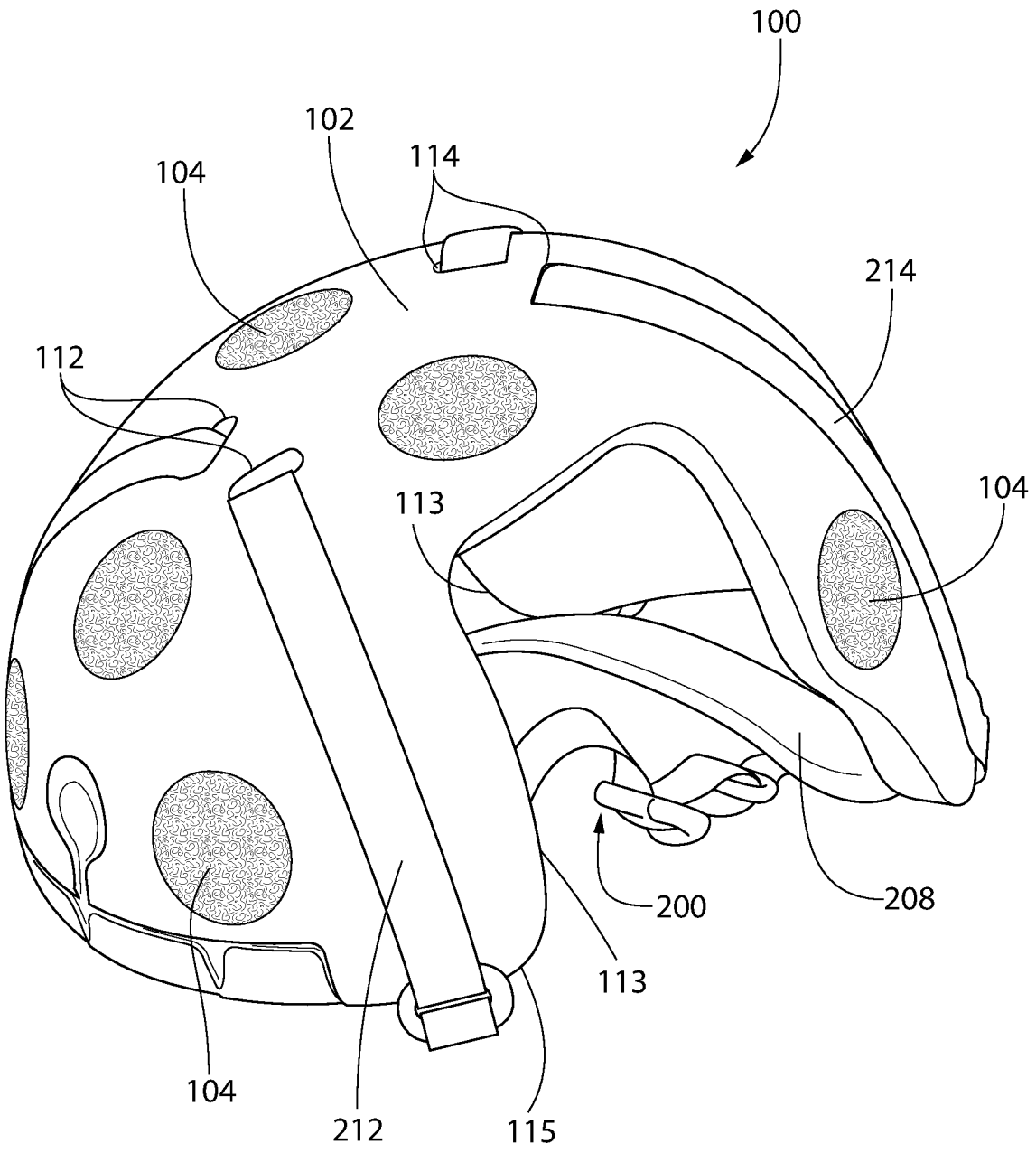
FIG. 3 is a top front left perspective view of a liner in accordance with an embodiment of the invention.
Figure 4:
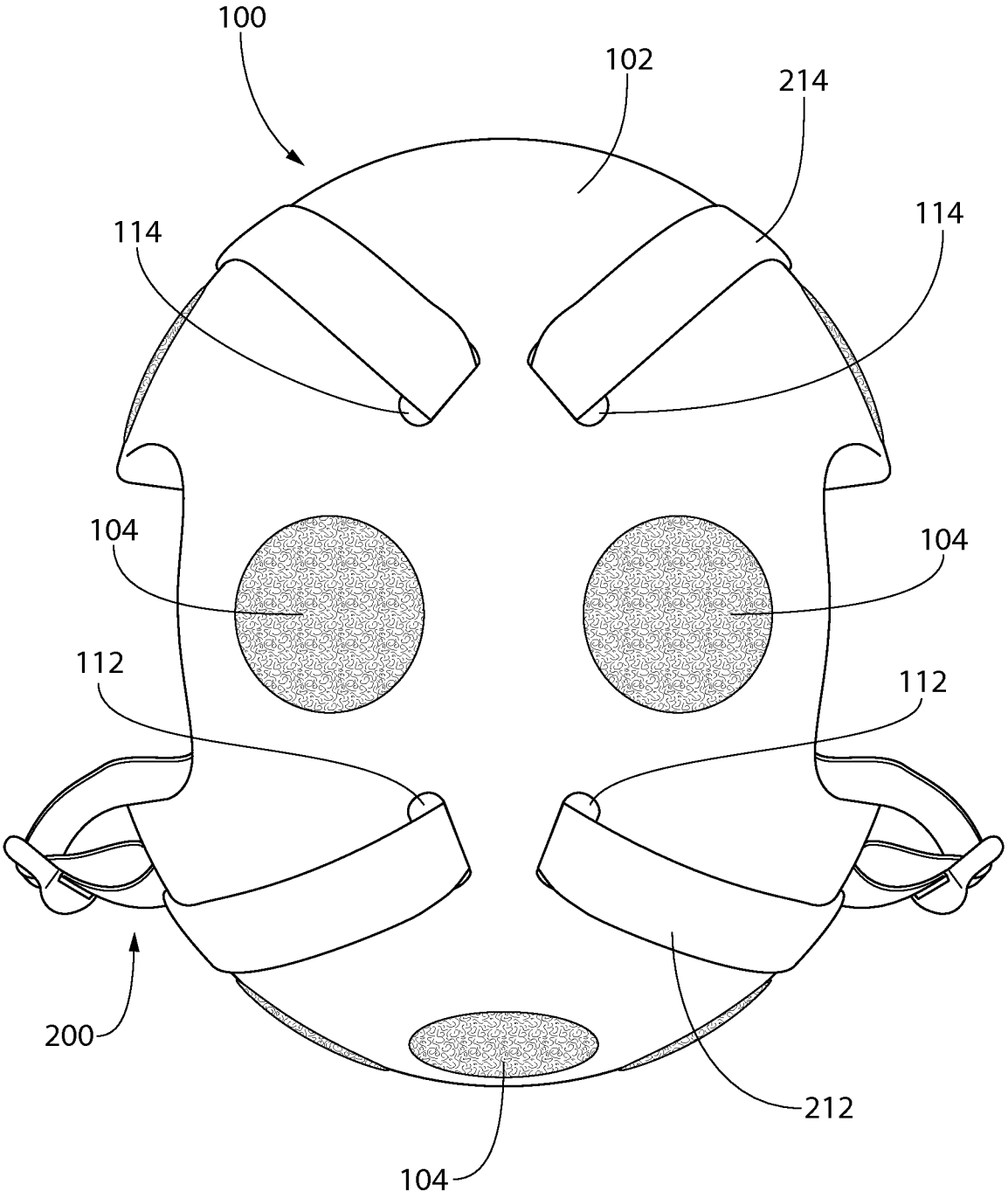
FIG. 4 is a top view of the liner of FIG. 3.

Referring to the drawings in detail, wherein like reference numerals indicate like elements throughout, there is shown in FIGS. 1-6 a liner, generally designated 100, in accordance with an exemplary embodiment of the present invention. In certain preferred embodiments of the present invention, liner 100 is configured to be positioned within an interior region of a head protection device, such as a helmet 300 (FIG. 2). More particularly, liner 100 in some embodiments is configured to be positioned between helmet 300 and a wearer's head during use and provide impact protection to the wearer. In preferred embodiments, liner 100 may be removably attached to helmet 300 during use. Helmet 300 may be any type of head protection helmet known in the art, for example, those used for sporting, police, or military purposes. In certain embodiments, helmet 300 is a standard infantry ballistic helmet. In some embodiments, helmet 300 is an advanced combat helmet (ACH).

In some embodiments, liner 100 generally includes a liner body 102 that is constructed from an impact-absorbing material. In some embodiments, for example, liner body 102 is made of expanded polypropylene. In other embodiments, liner body 102 is made of expanded polystyrene. In further embodiments, liner body may be made of open or closed cell polyurethane, blends of PVC and acrylonitrile butadiene rubber (NBR) (such as foam materials available under the ENSOLITE® brand), or other energy-absorbing foams known in the art. In some embodiments, liner body 102 is substantially rigid. In other embodiments, liner body 102 may be elastic or flexible. In some embodiments, liner body 102 is of a single-piece construction, having a unitary or monolithic structure. In some embodiments, having a single liner body 102 providing full impact coverage versus separate impact-absorbing pads may help distribute impact forces over a wider area, resulting in better protection for the wearer. In some embodiments, liner 100 includes a single liner body 102 that is sufficiently sized to extend from the forehead of the wearer to the back of the head of the wearer during use. In some embodiments, liner body 102 is sized to extend from the forehead of the wear to the nape of the neck of the wearer during use. In some embodiments, liner body 102 includes an outer surface that is convexly contoured to generally match the interior curvature of helmet 300. In one embodiment, liner body 102 is shaped such that it retains the same shape whether or not it is coupled to the helmet 300 and/or the user's head. In some embodiments, liner 100 includes a single liner body 102 that is dimensioned to fit along the interior of helmet 300 from the front 302 of helmet 300 to the back 304 of helmet 300. In some embodiments, liner body 102 is configured to entirely fit within the interior of helmet 300 and to not extend beyond the periphery of helmet 300 during use. In some embodiments, liner body 102 includes a plurality of cut-outs 113 extending from a bottom peripheral edge 115 of liner body 102 and the helmet 300 extends over the plurality of cut-outs 113. In some embodiments, liner body 102 includes an interior surface 106 that is concavely contoured to fit around the wearer's head during use. In some embodiments, liner body 102 has a generally uniform thickness between the convex outer surface and the concave interior surface 106. In some embodiments, liner body 102 has a thickness in a range from about 10 mm to about 20 mm, from about 12 mm to about 18 mm, or from about 14 mm to about 16 mm. In some embodiments, liner body 102 is at least 10 mm thick, at least 12 mm thick, at least 14 mm thick, at least 16 mm thick, at least 18 mm thick, or at least 20 mm thick. In some embodiments, liner body 102 has a thickness less than 20 mm.

In some embodiments, liner 100 is configured to provide different levels of impact attenuation to different locations around the wearer's head. For example, liner 100 may be configured to provide greater or lesser impact attenuation at the crown or front of the head versus the left and right sides. In some embodiments, different levels of impact attenuation can be achieved by having a liner body 102 with different densities of the impact-absorbing material at the different locations. In some embodiments, liner body 102 may include denser material at locations where greater impact attenuation is desired. In other embodiments, liner body 102 may have a variable thickness, for example, such that liner body 102 is thicker at portions where greater impact attenuation is desired.

In some embodiments, liner 100 is configured to be attached to helmet 300 preferably without requiring any tools or substantial modification of helmet 300. In some embodiments, liner 100 is configured to be removably attached to helmet 300. In some embodiments, liner 100 may be affixed to helmet 300 using one or more hook-and-loop or hook-and-pile type fasteners (e.g., VELCRO® or VELCOIN® brand fasteners). For example, the outer surface of liner body 102 may be provided with a plurality of loop or pile portions 104 that can engage with hook portions 306 arranged in the interior of helmet 300. It should be understood that, in other embodiments, liner body 102 may be provided with hook portions while the interior helmet 300 is provided with the loop or pile portions. Alternative types of fasteners may also be used according to further embodiments of the invention. For example, clamps, straps, buttons, snap fasteners, latches, or other mechanical fasteners could be used to removably attach liner 100 to helmet 300. In other embodiments, adhesives may be used, for example, adhesive tapes, pressure-sensitive adhesives, or putty-like adhesives (e.g., Blu Tack).

In some embodiments, liner 100 further includes a plurality of pads 108 that are configured to provide cushioning between the wearer's head and liner body 102 during use. In some embodiments, a total of two to twelve pads 108 are provided with liner 100. In some embodiments, liner 100 is provided with two, three, four, five, six, seven, eight, nine, ten, eleven, or twelve pads 108. It should be understood that more or fewer pads 108 may be included in other embodiments. In some embodiments, pads 108 are provided in connected pairs. In some embodiments, each of pads 108 has substantially the same shape. In other embodiments, pads 108 may include different shapes. In some embodiments, pads 108 may be square, rectangular, circular, or irregularly shaped. In some embodiments, each pad 108 has a thickness in a range from about 6 mm to about 20 mm, about 8 mm to about 18 mm, about 10 mm to about 16 mm, or about 12 mm to about 14 mm before compression. In some embodiments, each pad 108 is at least 6 mm thick, at least 8 mm thick, at least 12 mm thick, at least 14 mm thick, at least 16 mm thick, or at least 18 mm thick before compression. In one embodiment, each pad 108 is about 13 mm thick before compression. In further embodiments, each pad 108 has a width of about 40 to about 60 mm and a length of about 80 mm to about 110 mm. In one embodiment, each pad 108 has a width of about 50 mm and a length of about 95 mm.

In some embodiments, pads 108 are made from a material that is different than the material used to construct liner body 102. In some embodiments, pads 108 may include a soft or resilient material, such as compressible foam. In other embodiments, pads 108 may include a gel material. In some embodiments, pads 108 include a viscoelastic material. In certain preferred embodiments, pads 108 are constructed from a breathable material. In some embodiments, each of pads 108 is made from reticular foam that is enclosed in fabric. In some embodiments, pads 108 include a foam that is less dense than the impact-absorbing material of liner body 102. In some embodiments, pads 108 include plastic open cell reticular foam enclosed in a fleece material. In some embodiments, pads 108 are made from materials that do not substantially absorb or retain water. In some embodiments, pads 108 include foam having open cells that allow for drainage of water. In some embodiments, pads 108 are made from materials that absorb less water than certain polyurethane foams, such as those available under the ZORBIUM® brand.

In further embodiments, pads 108 may be individually positioned on, rearranged, and/or removed from liner body 102 in order to adjustably fit liner 100 to each wearer's head. In some embodiments, pads 108 may be individually positioned or repositioned on interior surface 106 of liner body 102, as shown in FIG. 2. In some embodiments, pads 108 may be removably secured to interior surface 106 of liner body 102 using, for example, hook-and-loop or hook-and-pile type fasteners (e.g., VELCRO® or VELCOIN® brand fasteners). Alternative types of fasteners may also be used according to further embodiments of the invention. For example, clamps, straps, buttons, snap fasteners, latches, or other mechanical fasteners could be used to removably attach pads 108 to liner body 102. In other embodiments, adhesives may be used, for example, adhesive tapes, pressure-sensitive adhesives, or putty-like adhesives (e.g., Blu Tack).

In some embodiments, pads 108 may be repositioned or removed from liner body 102 without having to remove liner body 102 from helmet 300. By being able to reposition and/or remove pads 108 individually, liner 100 may be custom fit to each wearer to increase comfort and/or stability according to certain preferred embodiments. Moreover, by having pads 108 that are separable from liner body 102, removal of one or more pads 108 in some embodiments will not diminish the impact protection provided by liner body 102 which remains in helmet 300.

In some embodiments, liner 100 further includes a front pad 110 that is configured to abut against the wearer's forehead during use. Front pad 110 in some embodiments may include materials that are different than the materials used in pads 108. In some embodiments, front pad 110 is a reinforced pad that may be wrapped or sheathed in leather, micro-suede, or other durable material. In some embodiments, front pad 110 includes the same foam material as pads 108 (e.g., plastic open cell reticular foam). In some embodiments, front pad 110 is removably attached to liner body 102 to allow for separation of front pad 110 from liner body 102. In some embodiments, front pad 110 is attached to liner body 102 using one or more hook-and-loop or hook-and-pile type fasteners (e.g., VELCRO® or VELCOIN® brand fasteners). In some embodiments, front pad 110 is configured to support greater weight than pads 108 because, for example, equipment such as night vision goggles, cameras, or other gear may be positioned on helmet 300 proximate front 302 during use which may create greater pressures on the forehead of the wearer.

Liner 100, in certain embodiments, additionally includes or is attachable to a retention system 200 which is configured to retain and secure liner 100 to the wearer's head during use. In some embodiments, retention system 200 is also attachable to helmet 300. As shown in FIG. 1, for example, in some embodiments retention system 200 may be connected to liner body 102 at various attachment points 210, which may be positioned at or proximate the front and rear of liner body 102. In some embodiments, there are a total of four attachment points 210. In some embodiments, for example, retention system 200 may be attached to liner body 102 using pins, bolts, screws, or other fastener at attachment points 210. In some embodiments, retention system 200 is configured in accordance with embodiments disclosed in U.S. Pat. No. 8,353,066, which is incorporated herein by reference in its entirety. In some embodiments, retention system 200 is configured to wrap around the wearer's chin during use. In some embodiments, for example, retention system 200 includes a plurality of retention straps (e.g., nylon webbing) which forms a chin holder 206 that engages the wearer's chin during use. Retention system 200 may further include a coupling component 202, such as a quick-connect fitting, that allows for the retention straps to be joined or disengaged during donning and doffing of helmet 300. In some embodiments, the retention straps of retention system 200 may be looped around one or more strap buckles 204 which are arranged and configured to allow adjustment of retention system 200, for example, to permit tightening or loosening of the retention straps as needed. In certain embodiments, retention system 200 further includes a nape pad 208 which is positioned below the rear of liner body 102 and configured to abut the back of the neck of the wearer during use.

Figure 5:
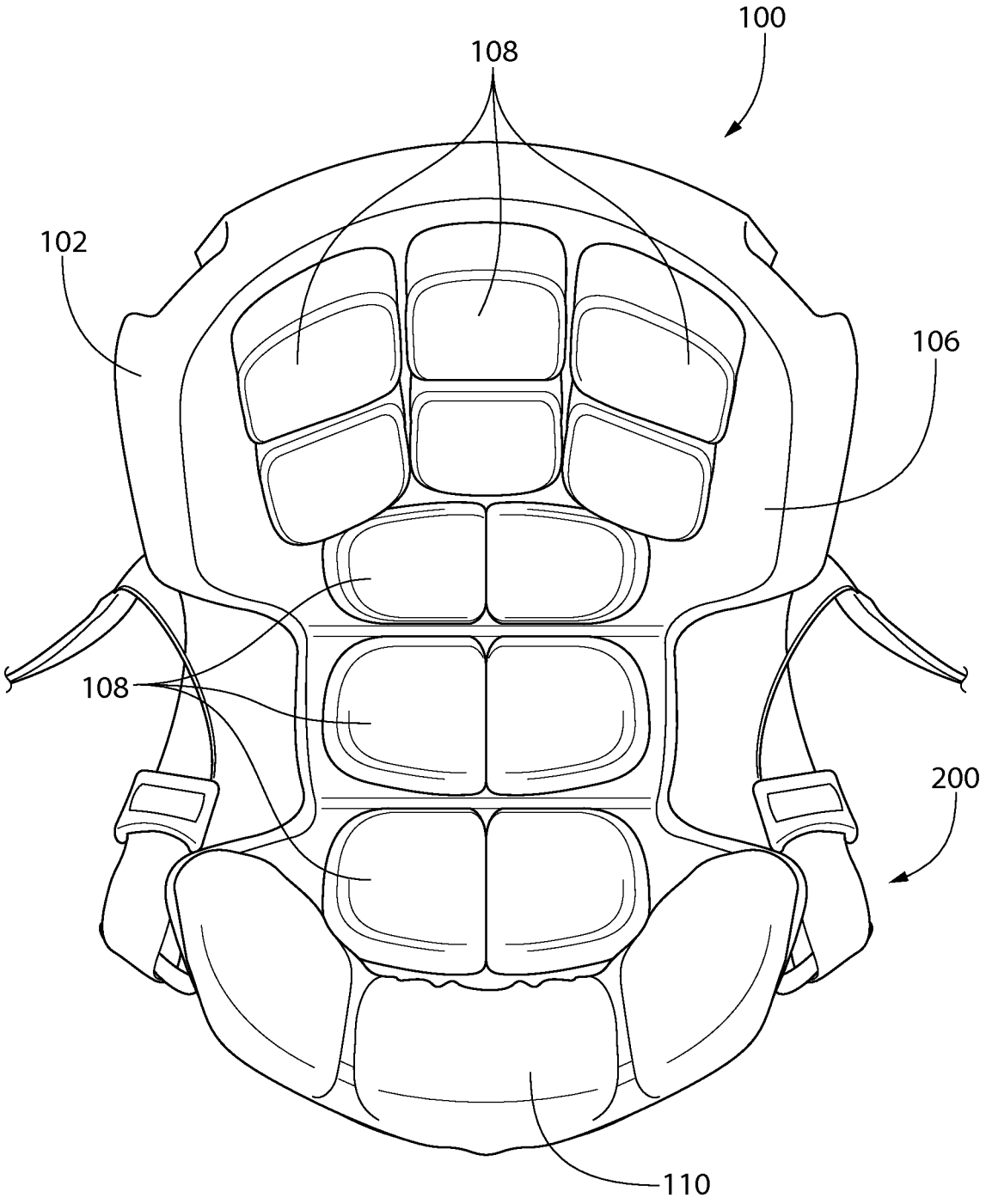
FIG. 5 is a bottom view of the liner of FIG. 3.
Figure 6:
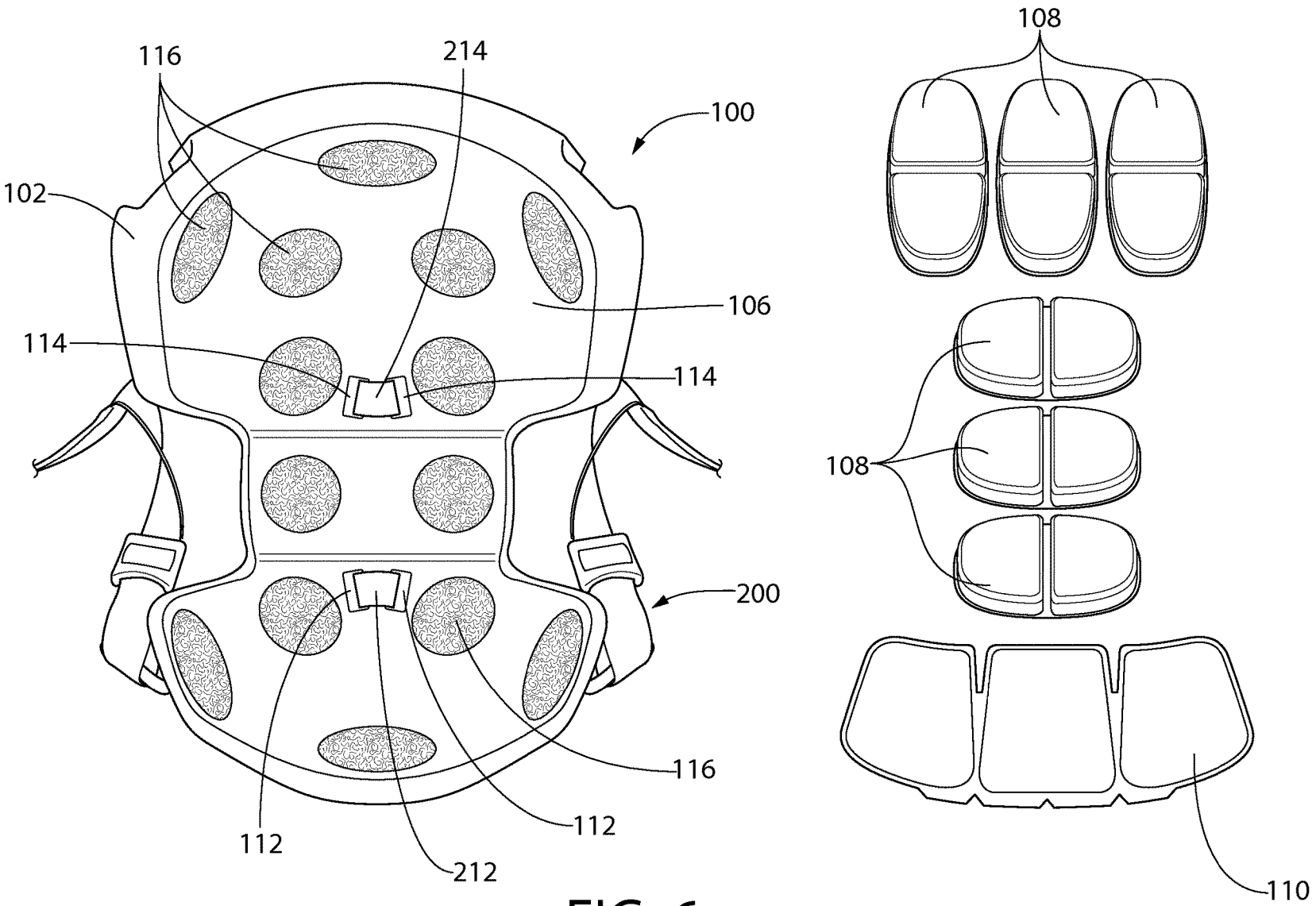
FIG. 6 is a bottom view of the liner of FIG. 3 with pads separated from the liner.

In other embodiments, retention system 200 may be connected to liner 100 without hardware (e.g., without pins, bolts, screws, or other fasteners) as shown, for example, in FIGS. 3-6. According to the embodiment of FIGS. 3-6, liner body 102 may include one or more apertures 112, 114 through which straps of retention system 200 may be woven through. In some embodiments, liner 100 includes a pair of front apertures 112 that are non-parallel to each other and a pair of rear apertures 114 that extend through the entire thickness of liner body 102 and provide attachment points for retention system 200 without the need for separate fasteners. Retention system 200 may include a front strap 212 that passes through front apertures 112 and a rear strap 214 that passes through rear apertures 114 to according to these embodiments. In some embodiments, front strap 212 may connect to a chin holder (e.g., chin holder 206 of FIG. 1), and rear strap 214 may connect to nape pad 208. As particularly shown in FIG. 6, which depicts liner 100 with pads 108 and front pad 110 separated from liner body 102, front strap 212 may pass over interior surface 106 of liner body 102 between front apertures 112. Similarly, rear strap 214 may pass over interior surface 106 between rear apertures 114. The portions of front strap 212 and rear strap 214 that pass over interior surface 106 may be covered by pads 108 when pads 108 are attached to liner body 102 (FIG. 5). Accordingly, in some embodiments, a portion of front strap 212 and a portion of rear strap 214 may be sandwiched between interior surface 106 of liner body 102 and one or more pads 108. As discussed above, pads 108 may be removably attached to liner body 102 via hook or loop patches 116 that may be positioned throughout interior surface 106 of liner body 102.

In some embodiments, liner 100 may be supplied alone or as a kit together with helmet 300. In some embodiments, liner 100 is supplied without retention system 200. In some embodiments, liner body 102 and pads 108 are supplied together as a kit, with or without helmet 300. In some embodiments, a kit includes liner body 102, pads 108, and retention system 200 attached to liner body 102.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a," "an," and "the" are not limited to one element but instead should be read as meaning "at least one."

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

What is claimed is:

1. A helmet comprising:

a helmet shell;

a liner comprising a liner body sized and coupled to an interior surface of the helmet shell and configured to fit around a portion of a wearer's head, the liner body comprising a plurality of cut-outs extending from a bottom peripheral edge of the liner body, the liner body comprised of an impact-absorbing material and having an outer surface with a convex curvature and an interior surface with a concave curvature;

a plurality of pads removably attached to the interior surface of the liner body, each of the plurality of pads being repositionable at different locations on the interior surface of the liner body; and a retention system attached to the liner body and configured to secure the liner to the wearer's head during use, the retention system including at least one strap extending through a pair of apertures disposed in the liner body and having a portion, extending between the pair of apertures, sandwiched between the liner body and at least one of the plurality of pads, the pair of apertures being a pair of front apertures, wherein the liner body includes a pair of rear apertures and the at least one strap includes a front strap passed through the pair of front apertures and a rear strap passed through the pair of rear apertures, wherein the helmet shell extends over the plurality of cut-outs, and wherein a first front aperture of the pair of front apertures is non-parallel to a second front aperture of the pair of front apertures.

2. The helmet of claim 1, further comprising one or more fasteners on the outer surface of the liner body, the one or more fasteners removably attaches the liner to the interior surface of the helmet shell.

3. The helmet of claim 2, wherein the one or more fasteners comprise hook-and-loop or hook-and-pile type fasteners or portions thereof.

4. The helmet of claim 1, wherein the impact-absorbing material is expanded polypropylene.

5. The helmet of claim 1, wherein the pads comprise a foam material enclosed in fabric.

6. The helmet of claim 1, wherein each of the pads can be repositioned at different locations on the interior surface of the liner body while the liner body is attached to the helmet.

7. The helmet of claim 1, wherein the pads comprise a material that does not absorb or retain water.

8. The helmet of claim 1, wherein the plurality of pads are removably attached to the interior surface of the liner body using hook-and-loop or hook-and-pile type fasteners.

9. The helmet of claim 1, wherein the liner body is of a single-piece construction having a unitary structure.

10. The helmet of claim 1, further comprising a front pad positioned at a front of the liner body.

11. The helmet of claim 1, wherein the retention system comprises a nape pad that abuts against a neck of the wearer.

12. The helmet of claim 1, wherein the liner body has a uniform thickness between the outer surface and the interior surface.

13. The helmet of claim 1, wherein the liner body is rigid.

14. The helmet of claim 1, wherein the liner provides different levels of impact attenuation to different portions of the wearer's head.

15. The helmet of claim 1, wherein the impact-absorbing material of the liner body has different densities at different locations along the liner body.

16. The helmet of claim 1, wherein the helmet shell is a ballistics helmet shell.

17. The helmet of claim 1, wherein the front strap extends along the outer surface of the liner body, goes into the first front aperture of the pair of front apertures to extend over the interior surface of the liner body, and comes out of the second front aperture of the pair of front apertures to extend along the outer surface of the liner body.

18. The liner helmet of claim 1, wherein the rear strap goes into a first rear aperture of the pair of rear apertures and comes out of a second rear aperture of the pair of rear apertures.

19. The liner helmet of claim 1, wherein the concave and convex curvatures of the liner body are retained whether or not the liner body is coupled to the helmet shell or the wearer's head.

20. The helmet of claim 1, wherein the liner body removably couples to the interior surface of the helmet shell.

21. The liner helmet of claim 20, wherein a plurality of hook-and-loop fasteners are disposed on the outer surface of the liner body.

22. The helmet of claim 1, wherein liner is removably coupled to an interior surface of the helmet shell using one or more hook-and-loop or hook-and-pile type fasteners.

* * * * *